US008398193B2

(12) United States Patent
Izawa et al.

(10) Patent No.: US 8,398,193 B2
(45) Date of Patent: Mar. 19, 2013

(54) INKJET RECORDING APPARATUS

(75) Inventors: Hideo Izawa, Chiba (JP); Akira Ishikawa, Chiba (JP); Kouichi Ooyama, Akita (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 116 days.

(21) Appl. No.: 13/135,750

(22) Filed: Jul. 14, 2011

(65) Prior Publication Data

US 2012/0019577 A1 Jan. 26, 2012

(30) Foreign Application Priority Data

Jul. 23, 2010 (JP) ..... 2010-166569

(51) Int. Cl.
*B41J 25/308* (2006.01)

(52) U.S. Cl. ..... 347/8

(58) Field of Classification Search ..... None
See application file for complete search history.

(56) References Cited

U.S. PATENT DOCUMENTS

2008/0284803 A1 11/2008 Ikeda et al.

FOREIGN PATENT DOCUMENTS

JP 2002-36525 A 2/2002
JP 2005-324328 A 11/2005

OTHER PUBLICATIONS

European Patent Office Search Report dated Nov. 9, 2011 (4 pages).

*Primary Examiner* — Stephen Meier
*Assistant Examiner* — Tracey McMillion
(74) *Attorney, Agent, or Firm* — Flynn, Theil, Boutell & Tanis, P.C.

(57) ABSTRACT

[Problem to be Solved] To provide an inkjet recording apparatus capable of adjusting a gap with high accuracy and easily. [Solution] The present invention provides an inkjet recording apparatus 100 including line heads 20 to 23 capable of recording on a recording medium 1, a head box 11 that houses the line heads 20 to 23, and gap adjustment cams 30 to 32 that abut on a lower surface of a bottom 11*b* in the head box 11, in which the head box 11 is slightly movable in an up-and-down direction by rotating the gap adjustment cams 30 to 32.

7 Claims, 7 Drawing Sheets

INKJET RECORDING APPARATUS

TECHNICAL FIELD

The present invention relates to an inkjet recording apparatus, and more specifically, to an inkjet recording apparatus capable of adjusting a gap with high accuracy and easily.

BACKGROUND ART

A line head type inkjet recording apparatus that records on a recording medium using a line head has been known.

In such an inkjet recording apparatus, recording (printing) may preferably be performed by bringing a distance between a recording medium and a lower end of the line head (hereinafter referred to as a "gap") as close as possible from the viewpoint of a quality such as a resolution. On the other hand, if the gap is too small, the line head and the recording medium may contact each other by vibrations of the apparatus and the recording medium. Therefore, a gap corresponding to an amount expecting a vibration width or the like is required to be adjusted.

There are various recording media. The quality of a required record is not uniform. Every time a material for the recording medium on which recording is to be performed and its thickness and a recording condition for the recording medium are changed, therefore, the gap between the line head and the recording medium may desirably be adjusted in response thereto.

However, the gap is generally difficult to precisely adjust for each condition. Therefore, the line head is located at a position where it can be used in common among all conditions, and is used. Therefore, the apparatus is configured by sacrificing finishes (register, a color developing state, a sharp degree, etc.) of a high-quality recording medium due to more precise gap adjustment for each condition in the present circumstances.

As an apparatus for moving the line head up and down, for example, an inkjet recording apparatus including a moving substrate that is made movable in a width direction with respect to a direction of travel of continuous paper, a posture adjustment plate that is supported so as to be swingably adjustable in a horizontal direction and an up-and-down direction with respect to the moving substrate, and a controller base that is provided so as to be movable up and down over a predetermined stroke with respect to the posture adjustment plate and in which a housing of a controller provided with a nozzle head is fixed to the controller base has been known (see, e.g., Patent Document 1).

This inkjet recording apparatus is configured so that a cylinder device causes the controller base to move up and down, and an abutment component on the side of the controller base abuts on an abutment component, for adjusting the height of a line head, attached to two points of the controller base and a screw component, serving as a height adjustment member of the line head, of a type including screws provided at two points of the posture adjustment plate so that a position in a height direction of the line head is determined. The apparatus is configured so that a locking mechanism in the screw component is released to perform a rotating operation of the screws so that an abutment position is changed, and the height of the line head is determined by operating the locking mechanism again after being adjusted to a proper height.

PRIOR ART DOCUMENTS

Patent Documents

[Patent Document 1] Japanese Unexamined Patent Application Publication No. 2005-324328

SUMMARY OF THE INVENTION

Problems that the Invention is to Solve

However, the inkjet recording apparatus discussed in the above-mentioned Patent Document 1 includes the height adjustment mechanism while performing a rotating operation of the screws, also performing the locking mechanism by a rotating operation of a nut, and requiring a tool for adjustment. Therefore, the apparatus does not intend to adjust the gap with high accuracy and in a short time during printing work.

The present invention has been made in view of the above-mentioned circumferences and is directed to providing an inkjet recording apparatus capable of adjusting a gap with high accuracy and easily.

Means for Solving the Problems

When the inventors of the present invention have earnestly made consideration to solve the above-mentioned problem, they have found out that the above-mentioned problem can be solved by moving a head box up and down using a gap adjustment cam, to complete the present invention.

More specifically, the present invention resides in (1) an inkjet recording apparatus including a line head capable of recording on a recording medium, a head box with the line head attached, and a gap adjustment cam that abuts on an lower surface of the bottom of the head box, and in which the head box is slightly movable in an up-and-down direction by rotating the gap adjustment cam.

The present invention resides in (2) the inkjet recording apparatus described in the above-mentioned item (1) in which the gap adjustment cam is an eccentric cam defined by a continuous curve.

The present invention resides in (3) the inkjet recording apparatus described in the above-mentioned item (1), in which the gap adjustment cam is an eccentric cam defined by a multistage curve.

The present invention resides in (4) the inkjet recording apparatus described in any one of the above-mentioned items (1) to (3), in which a driving mechanism for rotating the gap adjustment cam is switchable in a step-by-step manner.

The present invention resides in (5) the inkjet recording apparatus described in any one of the above-mentioned items (1) to (4), in which the gap adjustment cam includes an upstream gap adjustment cam disposed upstream in a direction of travel of the recording medium, a downstream gap adjustment cam disposed downstream, and a center gap adjustment cam disposed between the upstream gap adjustment cam and the downstream gap adjustment cam, and the upstream gap adjustment cam, the downstream gap adjustment cam, and the center gap adjustment cam abut on the head box curved in an arch shape along a lower surface of its bottom, and are synchronized with one another.

The present invention resides in (6) the inkjet recording apparatus described in any one of the above-mentioned items (1) to (5), in which a cam follower is provided on the lower surface of the bottom of the head box via a cam follower bracket, and the gap adjustment cam engages with the cam follower.

The present invention resides in (7) the inkjet recording apparatus described in any one of the above-mentioned items (1) to (6), further comprising an abutment pressure switching function for making an abutment pressure of the gap adjustment cam adjustable.

Advantage of the Invention

An inkjet recording apparatus according to the present invention includes a gap adjustment cam, and a head box is slightly moved in an up-and-down direction based on rotation of the gap adjustment cam so that the gap can be adjusted with high accuracy and easily.

Since a component configuration around the head box can be reduced, the inkjet recording apparatus can be miniaturized and made lightweight.

At this time, if the gap adjustment cam has a multistage shape and can be switched in a step-by-step manner, a position of the head box is easy to fix when a gap between a line head and a recording medium is changed.

If the gap adjustment cam is an eccentric cam defined by a continuous curve, the gap between the line head and the recording medium can be finely adjusted with higher accuracy.

In the inkjet recording apparatus according to the present invention, when an upstream gap adjustment cam, a downstream gap adjustment cam, and a center gap adjustment cam abut on a head box curved in an arch shape along a lower surface of its bottom, and are synchronized with one another, the head box can be moved up and down without being inclined in the arch shape.

In the inkjet recording apparatus according to the present invention, if a cam follower is provided on a lower surface of the bottom of the head box via a cam follower bracket, and a gap adjustment cam engages with the cam follower, when the gap adjustment cam rotates, the head box slightly moves in an up-and-down direction via the cam follower. In this case, the head box can be slightly moved smoothly.

In the inkjet recording apparatus according to the present invention, if the apparatus has an abutment pressure switching function for making an abutment pressure of a gap adjustment cam adjustable, the head box can be slightly moved even during an inkjet recording operation.

BEST MODE FOR CARRYING OUT THE INVENTION

Figure 1:
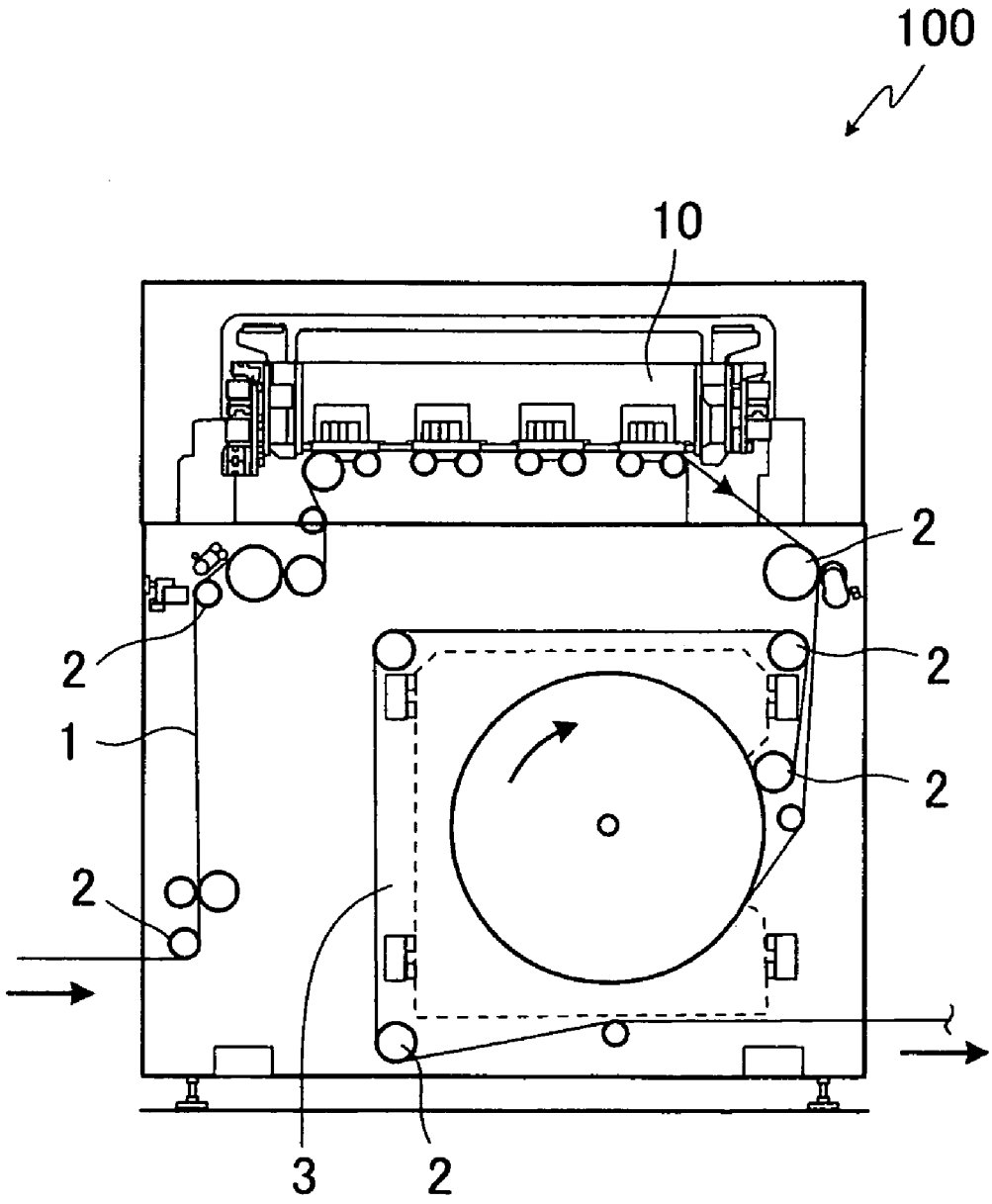
FIG. 1 is a front view illustrating an embodiment of an inkjet recording apparatus according to the present invention.

A preferred embodiment of the present invention will be described in detail while referring to figures, as needed. In the figures, the same elements are assigned the same reference numerals, and an overlapped description is omitted. A positional relationship such as the left, right, top and bottom is based on a positional relationship illustrated in the figures unless otherwise noted. Further, a dimensional ratio in the figures is not limited to a ratio as illustrated.

FIG. 1 is a front view illustrating an embodiment of an inkjet recording apparatus according to the present invention.

As illustrated in FIG. 1, an inkjet recording apparatus 100 according to the present embodiment includes an inkjet recording head unit 10 including a head box with a line head for recording on a recording medium 1 attached, a drier 3 positioned below the inkjet recording head unit 10 for heating and drying the recording medium 1 after the recording, and a plurality of guide rolls 2 for guiding the recording medium 1. More specifically, the inkjet recording apparatus 100 is an inkjet recording apparatus of a line head type having a line head.

In the inkjet recording apparatus 100, the recording medium 1 that has been carried in is guided by the guide rolls 2, to reach the bottom of the inkjet recording head unit 10. The line head provided in the inkjet recording head unit 10 records the recording medium 1.

The recorded recording medium 1 is guided by other guide rolls 2, to reach the dryer 3, where the recording medium 1 is dried. Then, the recording medium 1, which has been guided by the other guide rolls 2 and dried, is carried outward from the apparatus.

Figure 2:
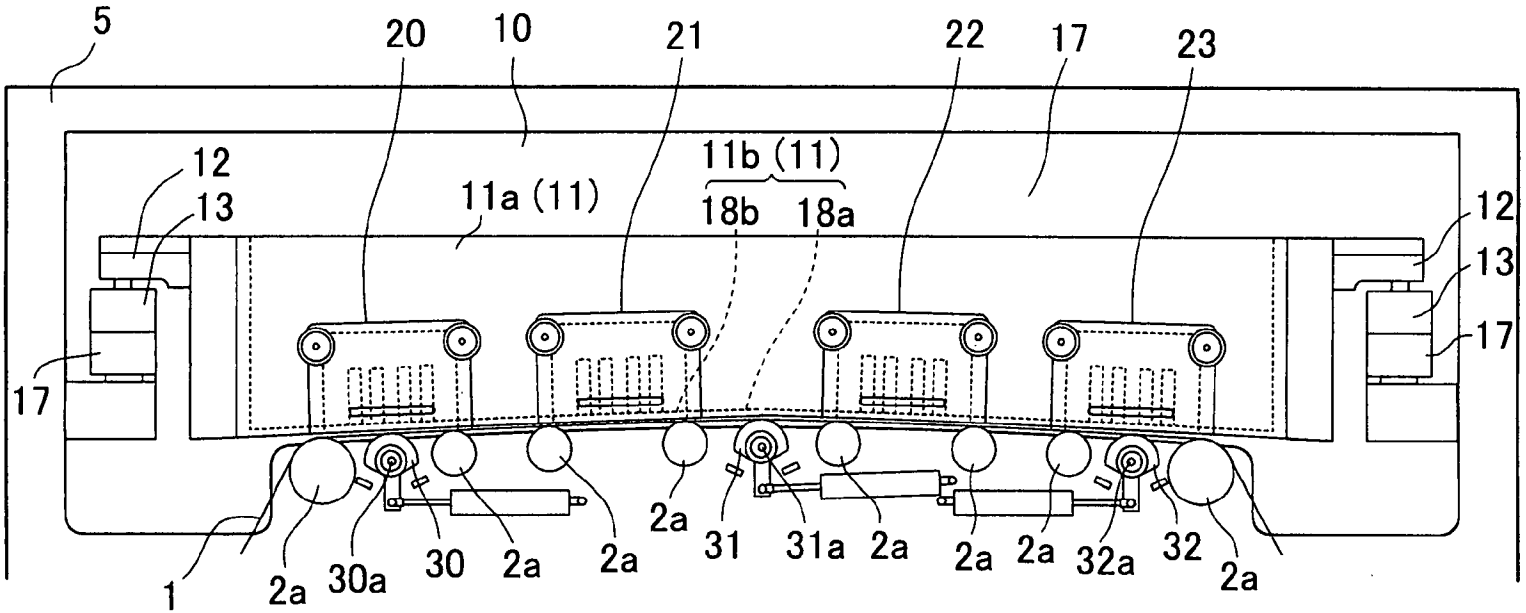
FIG. 2 is a front view illustrating an inkjet recording head unit in the inkjet recording apparatus according to the present embodiment.

FIG. 2 is a front view illustrating the inkjet recording head unit in the inkjet recording apparatus according to the present embodiment.

As illustrated in FIG. 2, the inkjet recording head unit 10 includes four line heads 20, 21, 22, and 23 (hereinafter referred to as "20 to 23") capable of recording on a recording medium, a head box 11 with the line heads 20 to 23 attached, head box brackets 12 provided at both ends of the head box 11, and air cylinders 13 for moving the head box 11 up and down via the head box brackets 12.

The inkjet recording apparatus 100 can record using four colors because it has the four line heads 20 to 23. For example, full-color recording can be performed using Y, M, C, and K colors, for example.

The head box 11 includes a bottom 11*b* and a housing 11*a* for covering the bottom 11*b*. The bottom 11*b* includes a bottom plate 18*a* for supporting the line heads 20 to 23, and a window 18*b* provided in the bottom plate 18*a*. Ink discharged from the line heads 20 to 23 is recorded on the recording medium 1 after passing through the window 18*b*.

The bottom 11*b* in the head box 11 is curved in a gentle arch shape. Therefore, the apparatus has the advantage that the line heads can be installed under a suitable installation condition.

The above-mentioned air cylinder 13 is fixed to a slide bracket 17 provided in a main body frame 5 in the inkjet recording apparatus 100. Therefore, in the inkjet recording apparatus 100, the inkjet recording head unit 10 is moved up and down relative to the main body frame 5 based on up-and-down movement of a piston lever in the air cylinder 13. This enables the head box 11 to be greatly moved up and down. For example, the head box 11 is moved to a raised position at the time of non-recording, and is moved to a lowered position at the time of recording.

The inkjet recording apparatus 100 may preferably include an abutment pressure switching function, for example, one of providing the air cylinder 13 with a release valve to make an abutment pressure of gap adjustment cams 30 to 32 adjustable. More specifically, the apparatus may preferably be provided with a release valve via which air supplied to the air supply unit is released when an air supply unit in the air cylinder 13 reaches a predetermined pressure or more. The apparatus is brought into a state where a burden on the cam is reduced at the time of gap adjustment so that the head box 11 can easily be slightly moved even during an inkjet recording operation.

In the inkjet recording apparatus 100, the plurality of gap adjustment cams 30, 31, and 32 (hereinafter referred to as "30 to 32") abut on the head box 11 along a lower surface of the bottom 11*b* via cam followers, described below.

The gap adjustment cams 30 to 32 include a pair of gap adjustment cams (hereinafter referred to as "upstream gap adjustment cams" for convenience) 30 disposed upstream in a direction of travel of the recording medium 1, a pair of gap adjustment cams (hereinafter referred to as "downstream gap adjustment cams" for convenience) 32 disposed downstream, and a pair of gap adjustment cams (hereinafter referred to as "center gap adjustment cams") 31 disposed between the upstream gap adjustment cam 30 and the downstream gap adjustment cam 32.

All the upstream gap adjustment cam 30, the center gap adjustment cam 31, and the downstream gap adjustment cam 32 have the same fan shape.

Figure 3:
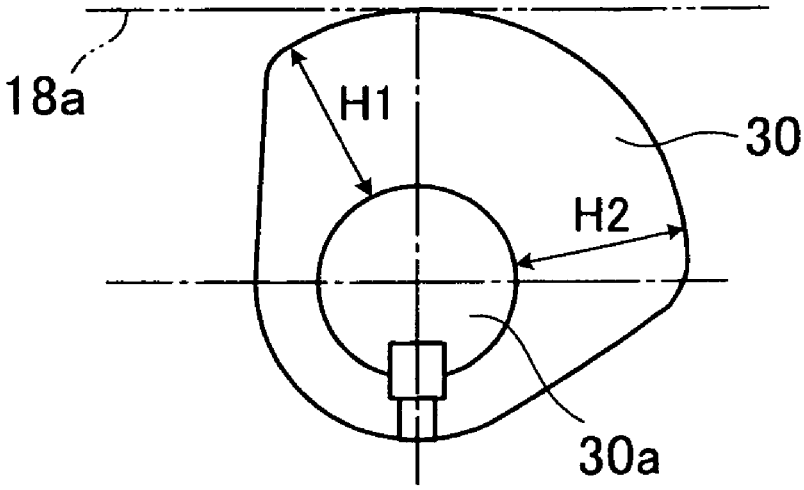
FIG. 3 is an enlarged view illustrating a gap adjustment cam in the inkjet recording apparatus according to the present embodiment.

FIG. 3 is an enlarged view illustrating a gap adjustment cam in the inkjet recording apparatus according to the present embodiment.

As illustrated in FIG. 3, the upstream gap adjustment cam (gap adjustment cam) 30 is an eccentric cam defined by a continuous curve fixed to a first cam shaft 30*a*, described below, and has a shape in which its diameter gradually decreases from one end toward the other end so that a diameter H1>a diameter H2. At this time, a difference between the diameter H1 and the diameter H2 may preferably be set to approximately 0.5 mm, for example. The center gap adjustment cam 31 and the downstream gap adjustment cam 32 have the same shape, and hence the description thereof is omitted FIG. 4 is a schematic view illustrating a state where a head box and an upstream gap adjustment cam abut on each other via a cam follower in the inkjet recording apparatus according to the present embodiment.

Figure 4:
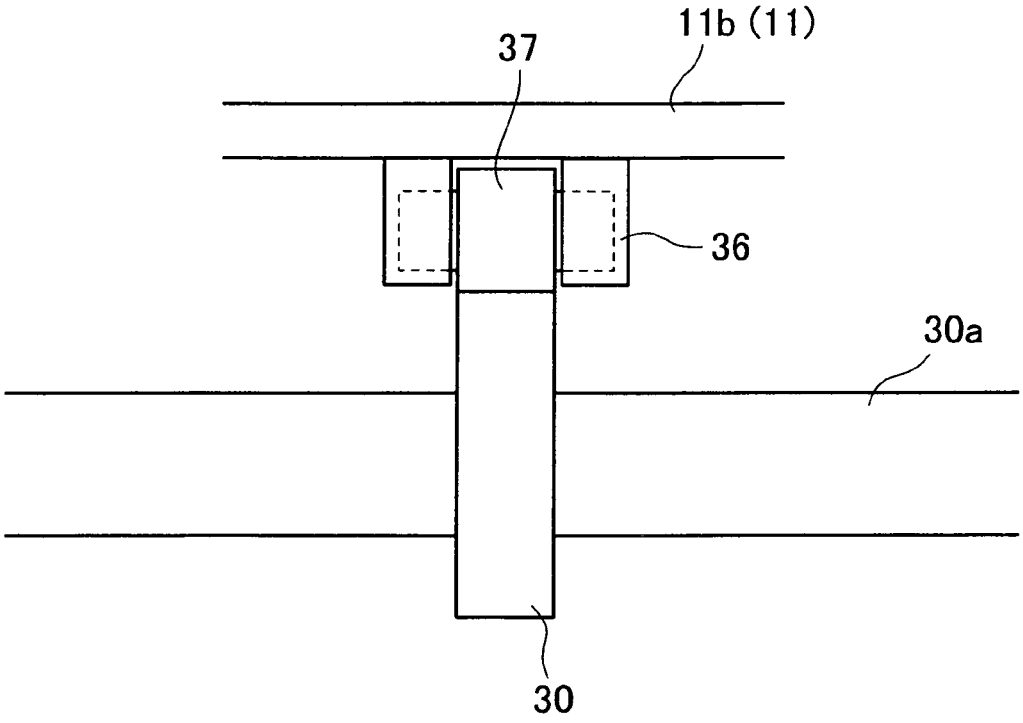
FIG. 4 is a schematic view illustrating a state where a head box and a gap adjustment cam abut on each other via a cam follower in the inkjet recording apparatus according to the present embodiment.

As illustrated in FIG. 4, in the inkjet recording apparatus 100, a cam follower 37 is provided on the lower surface of the bottom 11*b* (the bottom plate 18*a*) in the head box 11 via a cam follower bracket 36.

On the other hand, the upstream gap adjustment cam 30 is attached to a first cam shaft 30*a*.

When the upstream gap adjustment cam 30 abuts on the cam follower 37, they both engage with each other. More specifically, when the upstream gap adjustment cam 30 rotates, the cam follower 37 rotates in response thereto. The center gap adjustment cam 31 and the downstream gap adjustment cam 32 are also similarly provided with cam followers.

In the inkjet recording apparatus 100, when the gap adjustment cams 30 to 32 rotate, the head box 11 slightly moves in an up-and-down direction via each of the cam followers. Therefore, the arch-shaped head box can be slightly moved without being inclined and smoothly.

Figure 5:
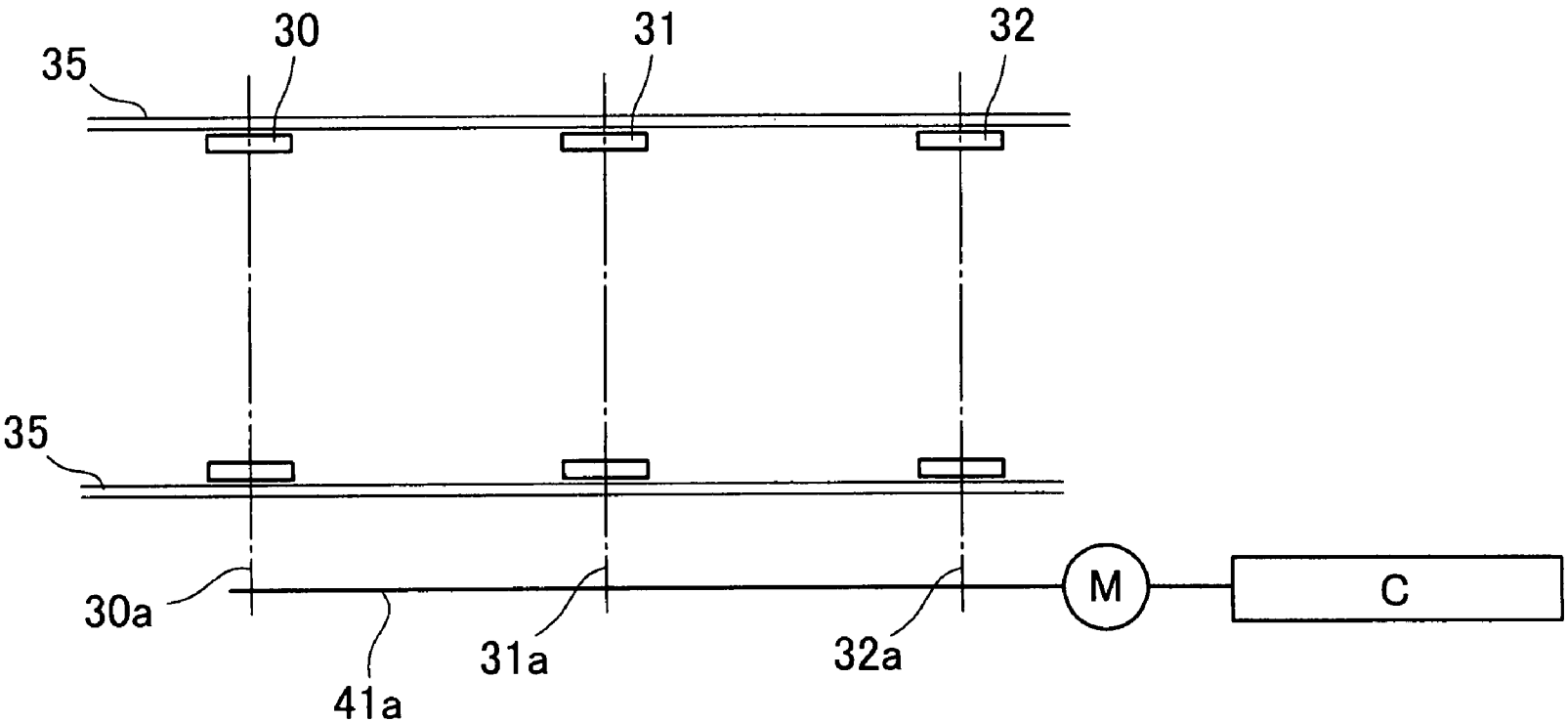
FIG. 5 is a top schematic view for illustrating a state where a gap adjustment cam is arranged in the inkjet recording apparatus according to the present embodiment.

FIG. 5 is a top schematic view for illustrating a state where a gap adjustment cam in the inkjet recording apparatus according to the present embodiment is arranged.

As illustrated in FIG. 5, as the gap adjustment cam, a pair of upstream gap adjustment cams 30 is provided at both ends of the first cam shaft 30*a*, a pair of center gap adjustment cams 31 is provided at both ends of a second cam shaft 31*a*, and a pair of downstream gap adjustment cams 32 is provided at both ends of a third cam shaft 32*a*. The first cam shaft 30*a*, the second cam shaft 31*a*, and the third cam shaft 32*a* are supported on a main body frame 35.

The first cam shaft 30*a*, the second cam shaft 31*a*, and the third cam shaft 32*a* are rotatable in a state where they are synchronized with one another by a driving mechanism (e.g., a change gear) and a driving motor M. A controller C controls the driving motor M.

Figure 6:
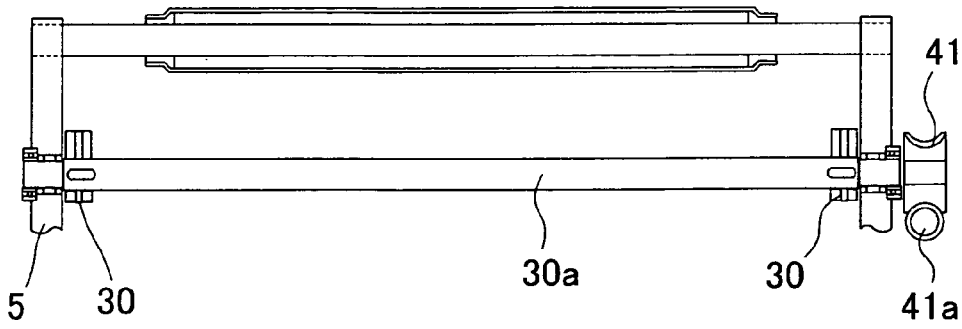
FIGS. 6 (*a*) and 6 (*b*) are schematic views illustrating examples of a driving mechanism used in the inkjet recording apparatus according to the present embodiment.
Figure 6:
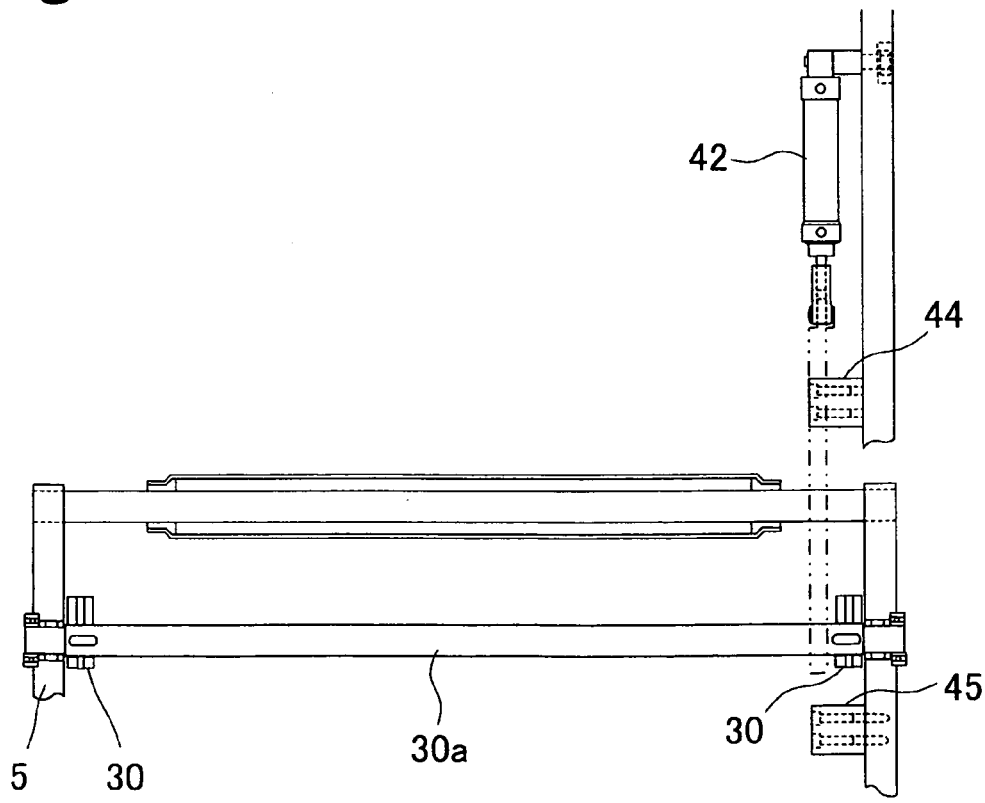

FIGS. 6 (*a*) and 6 (*b*) are schematic views illustrating an example of a driving mechanism used for the inkjet recording apparatus according to the present embodiment.

As illustrated in FIG. 6 (*a*), a combination of a worm wheel 41 and a worm 41*a* is used in the case of single step switching, for example, as a driving mechanism. The worm wheel 41 is attached to the first cam shaft 30*a*, the second cam shaft 31*a*, or the third cam shaft 32*a*.

Since the first cam shaft 30*a*, the second cam shaft 31*a*, and the third cam shaft 32*a* are synchronized with one another by the worm 41*a*, the gap adjustment cams 30 to 32 simultaneously rotate.

On the other hand, an air cylinder (hereinafter referred to as an "an air cylinder for cam" for convenience) 42 is used in the case of two-position switching, for example, as a driving mechanism, as illustrated in FIG. 6 (*b*). The air cylinder for cam 42 is attached to the first cam shaft 30*a*, the second cam shaft 31*a*, or the third cam shaft 32*a*. A direct acting mechanism for a piston lever in the air cylinder for cam 42 is converted into a cam shaft rotating mechanism. The inkjet recording apparatus 100 is provided with a first stopper 44 and a second stopper 45 so that direct acting movement for the piston lever in the cylinder for cam 42 is positioned at two positions, i.e., a push-position and a pull-position. More specifically, the cam shaft rotates based on sliding of the piston lever in the air cylinder for cam 42. The piston lever abuts on the first stopper 44 or the second stopper 45 so that the rotation of the cam shaft is stopped.

The recording medium is switched into ones of two types of sizes limited to predetermined thicknesses of thick paper and thin paper. When another printing condition is not changed, for example, the inkjet recording apparatus 100 can be of a two-position switching type. In this case, the gap adjustment cam may be an eccentric cam defined by a continuous curve, as illustrated in FIG. 3, or may be a step-by-step eccentric cam having a two-step switching height.

In the inkjet recording apparatus 100, the rotations of the gap adjustment cams 30 to 32 can also be controlled in a single step manner or may be switched in a step-by-step manner by selecting a driving mechanism using a controlled motor or the like. When the rotations are switched in a step-by-step manner, the rotations can be switched at several types of height positions previously defined and used. While the rotations cannot be continuously finely adjusted, they become easy to switch and set to defined heights without any errors. A position of the head box 11 can be switched at once to a previously defined position when gaps between the line heads 20 to 23 and the recording medium 1 are changed.

In the inkjet recording apparatus 100 according to the present embodiment, the recording medium 1 is guided to a guide roll 2*a*, to pass between the inkjet recording head unit 10 and each of the cam shafts 30*a*, 31*a*, and 32*a*. At this time, the recording medium 1 also passes through a route curved in an arch shape along the bottom 11*b* in the head box 11 curved in an arch shape. Therefore, in the inkjet recording apparatus 100, appropriate tension can be applied to the recording medium 1. Thus, the apparatus has the advantages that generation of creases on the recording medium 1 and vibration of the recording medium 1 by a machine can be reduced. A distance between the bottom 11*b* in the head box 11 and the recording medium 1, i.e., the size of a gap may preferably be set to 0.5 to 1 mm.

A method for adjusting a gap will be described below.

First, a recording medium and an inkjet recording condition are changed, and a gap is set according to a material for a recording medium on which recording is to be performed and its thickness and a recording condition for the recording medium.

When a combination of the worm wheel 41 and the worm 41*a* is used, for example, as a driving mechanism, for example, the controller C is used, and the driving motor M drives a driving mechanism in response to a driving signal from the controller C. Consequently, the first cam shaft 30*a*, the second cam shaft 31*a*, and the third cam shaft 32*a* are synchronized to rotate, the gap adjustment cams 30 to 32 respectively attached to the cam shafts also rotate based thereon, and the head box 11 slightly moves in an up-and-down direction via each of the cam followers 37 that abut thereon. Thus, the gap can be adjusted with high accuracy and easily. The controller C controls respective positions where the gap adjustment cams 30 to 32 stop rotating.

When the air cylinder for cam 42 is used, for example, as a driving mechanism, air is supplied to the air cylinder for cam 42 in response to the driving signal from the controller. Consequently, the first cam shaft 30*a*, the second cam shaft 31*a*, and the third cam shaft 32*a* rotate based on sliding movement of the piston lever. The gap adjustment cams 30 to 32 respectively attached to the cam shafts also rotate based thereon, and the head box 11 slightly moves in an up-and-down direction via each of the cam followers 37 that abut thereon. Thus, the gap can be adjusted with high accuracy and easily. The piston lever abuts on a stopper so that the gap adjustment cams 30 to 32 stop rotating.

Although the embodiment of the present invention has been described above, the present invention is not limited to the above-mentioned embodiment.

Although the inkjet recording apparatus 100 according to the present embodiment includes the drier 3 for heating and drying the recording medium 1 after recording, for example, the present invention is not limited to this. For example, the recording medium may be dried by a drier separately provided after recording is performed thereon.

The number of inkjet recording apparatuses 100 according to the present embodiment is not limited to one. A plurality of inkjet recording apparatuses may be arranged. For example, the first inkjet recording apparatus 100 may record a front surface of a recording medium, and the second inkjet recording apparatus 100 may record a back surface of the recording medium.

While the inkjet recording apparatus 100 according to the present embodiment includes the four line heads, it may include one to three line heads, or may include five or more line heads. The color of the ink to be injected into each of the line heads is not particularly limited. The ink may be a dye, a pigment, or the like, or may be a medical agent such as a grazing agent or a flameproofing agent. Further, the ink may be water-based or oil-based.

While the bottom 11*b* in the head box 11 is curved in an arch shape in the inkjet recording apparatus 100 according to the present embodiment, its shape is not limited to this.

While a total of six gap adjustment cams are provided in the inkjet recording apparatus 100 according to the present embodiment, the present invention is not limited to this. The number of gap adjustment cams may be freely increased or decreased depending on the size of the head box.

While the gap adjustment cams 30 to 32 abut on the bottom 11*b* in the head box 11 via the cam follower 37 in the inkjet recording apparatus 100 according to the present embodiment, the gap adjustment cams may directly abut on the bottom of the head box without via the cam follower 37.

While the shape of the gap adjustment cam is a fan shape in the inkjet recording apparatus 100 according to the present embodiment, the present invention is not limited to this.

While the gap adjustment cams 30 to 32 are eccentric cams defined by a continuous curve, they may be an eccentric cam defined by a multistage curve.

Figure 7:
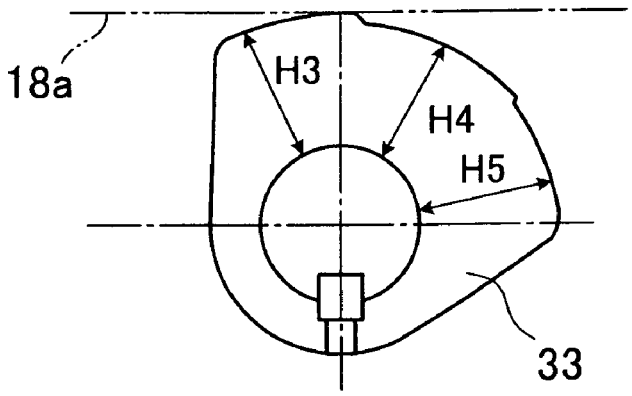
FIG. 7 is an enlarged view illustrating a gap adjustment cam in an inkjet recording apparatus according to another embodiment.

FIG. 7 is an enlarged view illustrating a gap adjustment cam in an inkjet recording apparatus according to another embodiment.

As illustrated in FIG. 7, a gap adjustment cam 33 is an eccentric cam defined by a multistage curve, includes an area having a predetermined diameter on a circumference, and has a three-stage shape in which a diameter H3>a diameter H4 and a diameter H4>a diameter H5.

When the eccentric cam defined by a multistage curve is used, a gap can be set without any errors and easily to a defined size instead of being unable to be continuously finely adjusted. In the case of a two-stage shape, an air cylinder for cam may be suitably used as the above-mentioned driving mechanism.

The recording medium 1 used in the inkjet recording apparatus 100 according to the present embodiment is not particularly limited to paper, a film, a metal foil, and so on.

INDUSTRIAL APPLICABILITY

The inkjet recording apparatus according to the present invention can be used as an apparatus for recording on a recording medium using an inkjet method. According to this inkjet recording apparatus, a gap can be adjusted with high accuracy and easily. Therefore, a record can be produced under the most suitable recording condition. Multifaceted effects such as an improvement in accuracy, an improvement in production efficiency, stability of a quality, and reduction of an adjustment time can be obtained.

DESCRIPTION OF REFERENCE NUMERALS

1 recording medium
2, 2*a* guide roll
3 drier
5 main body frame
10 inkjet recording head unit
11 head box
11*a* housing
11*b* bottom
12 head box bracket
13 air cylinder
17 slide bracket
18*a* bottom plate
18*b* window

20, 21, 22, 23 line head
30 upstream gap adjustment cam (gap adjustment cam)
30*a* first cam shaft (cam shaft)
31 center gap adjustment cam (gap adjustment cam)
31*a* second cam shaft (cam shaft)
32 downstream gap adjustment cam (gap adjustment cam)
32*a* third cam shaft
33 gap adjustment cam
36 cam follower bracket
37 cam follower
41 worm wheel
41*a* worm
42 air cylinder for cam
44 first stopper
45 second stopper
100 inkjet recording apparatus
C controller
H1, H2, H3, H4, H5 diameter
M driving motor

The invention claimed is:

1. An inkjet recording apparatus comprising:

a line head capable of recording on a recording medium;

a head box with the line head attached; and a gap adjustment cam that abuts on a lower surface of a bottom of the head box, wherein the head box is slightly movable in an up-and-down direction by rotating the gap adjustment cam.

2. The inkjet recording apparatus according to claim 1, wherein the gap adjustment cam is an eccentric cam defined by a continuous curve.

3. The inkjet recording apparatus according to claim 1, wherein the gap adjustment cam is an eccentric cam defined by a multistage curve.

4. The inkjet recording apparatus according to claim 1, wherein a driving mechanism for rotating the gap adjustment cam is switchable in a step-by-step manner.

5. The inkjet recording apparatus according to claim 1, wherein the gap adjustment cam includes an upstream gap and adjustment cam disposed upstream in a direction of travel of the recording medium, a downstream gap adjustment cam disposed downstream, and a center gap adjustment cam disposed between the upstream gap adjustment cam and the downstream gap adjustment cam, and the upstream gap adjustment cam, the downstream gap adjustment cam, and the center gap adjustment cam abut on the head box curved in an arch shape along a lower surface of its bottom, and are synchronized with one another.

6. The inkjet recording apparatus according to claim 1, wherein a cam follower is provided on the lower surface of the bottom of the head box via a cam follower bracket, and the gap adjustment cam engages with the cam follower.

7. The inkjet recording apparatus according to claim 1, further comprising an abutment pressure switching function for making an abutment pressure of the gap adjustment cam adjustable.

* * * * *